United States Patent [19]

Motoda

[11] 3,945,612

[45] Mar. 23, 1976

[54] LIFTING APPARATUS

[76] Inventor: Kenro Motoda, 9-32-4, Kami-Kitazawa, Setagaya, Tokyo, Japan

[22] Filed: Oct. 7, 1974

[21] Appl. No.: 512,888

Related U.S. Application Data

[63] Continuation-in-part of Ser. No. 460,144, April 11, 1974, abandoned, which is a continuation of Ser. No. 356,064, May 1, 1973, abandoned.

[52] U.S. Cl. ..... 254/173 R; 212/39 MS; 254/175.7; 307/317 R; 317/33 VR; 323/22 Z

[51] Int. Cl.[2] ..... B66D 1/48

[58] Field of Search ..... 323/8, 22 Z; 317/148.5 B, 317/33 VR; 307/317 R, 318, 237; 254/173 R, 146, 173 B, 175.5, 175.7; 212/1, 86, 39 MS; 318/626; 244/77 M; 114/144 R

[56] References Cited

UNITED STATES PATENTS

| | | | |
|---|---|---|---|
| 3,052,878 | 9/1962 | Berry | 212/86 |
| 3,129,686 | 4/1964 | Sakson | 114/144 R |
| 3,233,746 | 2/1966 | Fawell | 212/86 |
| 3,426,263 | 2/1969 | Hennigan et al. | 323/8 |
| 3,596,163 | 7/1971 | Barrett | 114/144 R |

*Primary Examiner*—Robert J. Spar
*Assistant Examiner*—Lawrence J. Oresky
*Attorney, Agent, or Firm*—Wenderoth, Lind & Ponack

[57] ABSTRACT

A lifting apparatus is provided with an upper limit position setting device which comprises a limit switch installed on a fixed part of the lifting apparatus and a dog provided on a rope which is adapted to move a load upward and downward. The dog and the limit switch are so arranged to determine the upper limit position to which the movement of the load is allowable.

2 Claims, 6 Drawing Figures

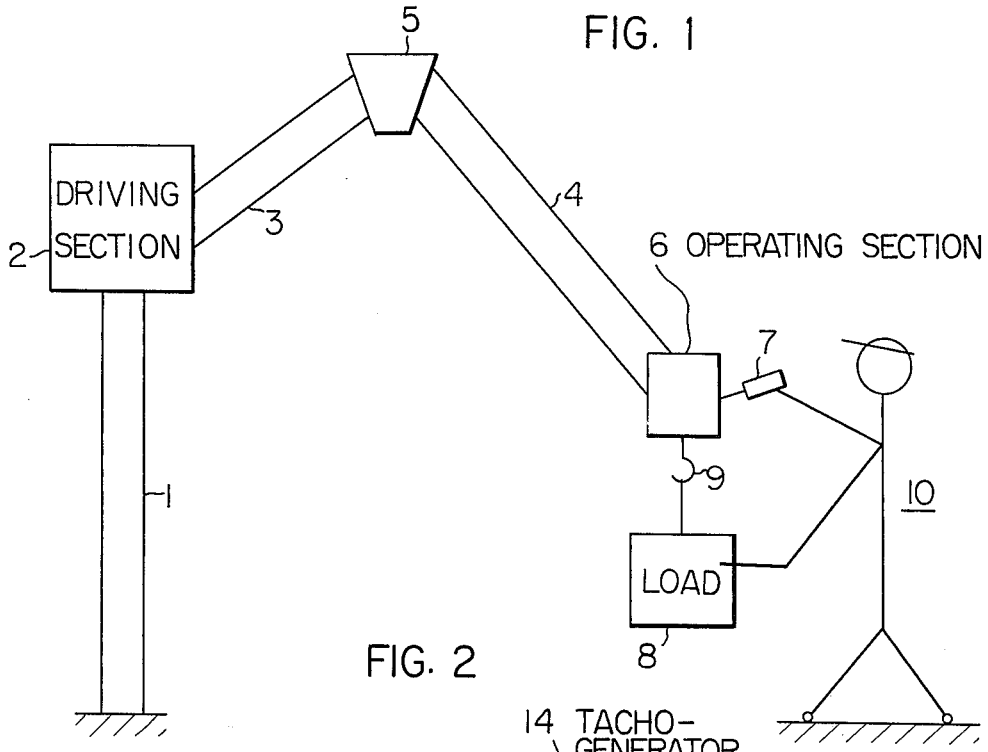
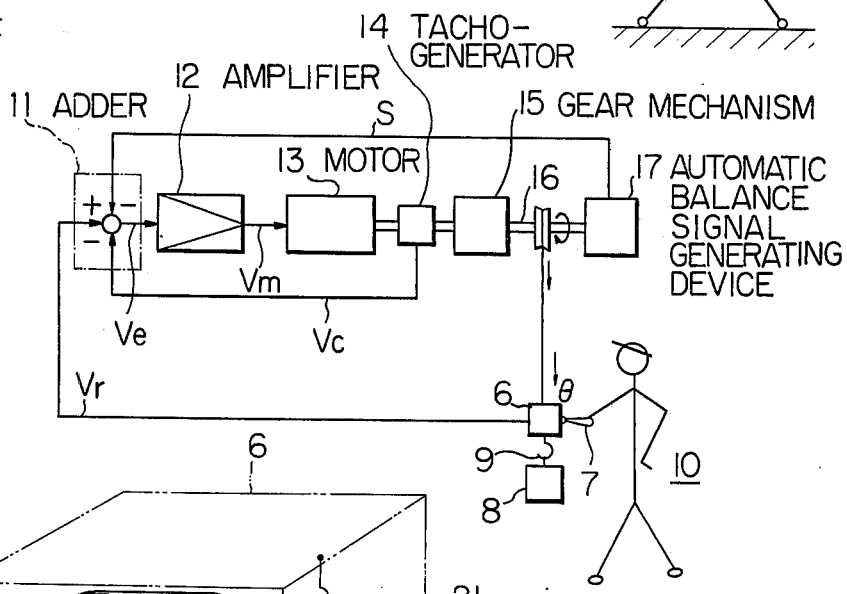
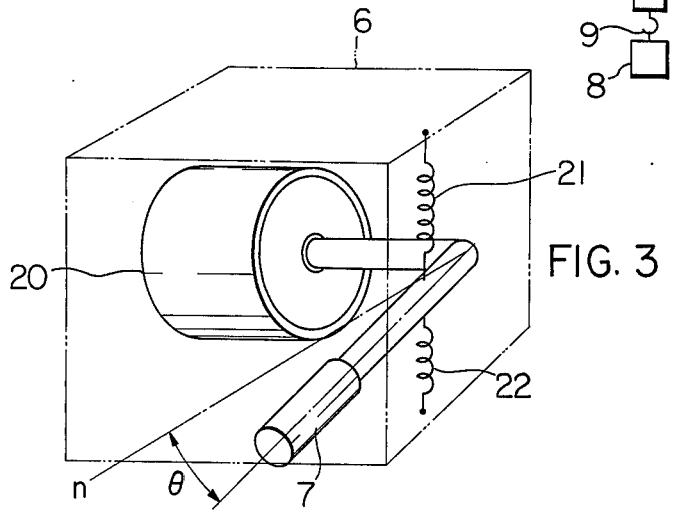
FIG. 3

LIFTING APPARATUS

This application is a continuation-in-part of application Ser. No. 460,144 filed on Apr. 11, 1974, now abandoned, which in turn is a continuation of application Ser. No. 356,064 filed on May 1, 1973, now abandoned.

BACKGROUND OF THE INVENTION

This invention relates to lifting apparatuses for lifting heavy materials or loads and more particularly to an upper limit position setting device which operates to prevent the lifting of a load higher than a predetermined height in the lifting apparatus.

A conventional lifting apparatus, as is indicated in FIG. 1, comprises: a support 1; a driving section 2 which is provided on the support 1 for driving the apparatus; arms 3 and 4 connected to the driving section 2 through an arm connecting member 5 which is adapted to connect arms 3 and 4 to each other; an operating section 6 which is provided at the end of the arm 4; and a load carrying or supporting member 9 which is adapted to support a load 8 which is to be moved to a desired place. The operating section 6 has a control lever 7 which is operated by an operator 10.

An electrical arrangement of this conventional lifting apparatus is shown in FIG. 2, and a structure of the operating section 6 is illustrated in FIG. 3.

The electrical arrangement shown in FIG. 2 includes an adder 11 which carries out addition and subtraction operations of a target speed signal Vr, an automatic balance signal S and a speed feedback signal Vc to apply a driving signal Ve to an amplifier 12. An electric motor 13 is driven with the aid of a driving signal $Vm$ obtained by amplifying the driving signal $Ve$ by the amplifier 12. A tachogenerator 14 is connected to the rotary shaft of the motor 13 to produce the speed feedback signal $Vc$ proportional to the rate of rotation of the rotary shaft and is connected to a reduction gear mechanism 15. An automatic balance signal generating device 17 is connected to an output shaft 16 of the gear mechanism 15 and when the vertical movement of the load is stopped, produces the automatic balance signal S which is employed to maintain the load wherever it is stopped.

The operating section 6, as is shown in FIG. 3, comprises a potentiometer 20 for providing the target speed signal $Vr$ corresponding to the vertical displacement (angle $\theta$ of rotation) of the control lever 7 from the neutral position $n$ of the control lever 7, and a pair of springs 21 and 22 to bias the control lever to the neutral position $n$. One end of the upper spring 21 is connected to the control lever 7, while the other end is connected to the upper wall of the operating section 6. Similarly, one end of the lower spring 22 is connected to the control lever, while the other end is connected to the lower wall of the operating section 6.

With the lifting apparatus thus organized, the operator 10 hangs a heavy load 8 on the load carrying member 9 and moves the load vertically to a desired place by operating the control lever 7.

When the control lever 7 is not operated, the control lever 7 is set at the neutral position $n$ by the mutual action of the upper and lower springs 21, and 22 and accordingly, no target speed signal $Vr$ for driving the motor 13 is produced by the potentiometer 20, that is, the target speed is zero. In this case, an automatic balance signal S corresponding to the weight of the load 8 is produced by the automatic balance signal generating device 17, whereby the position of the load 8 is maintained unchanged, that is, the load is not moved downward. In other words, the driving power of the motor 13 is controlled by the automatic balance signal S which is dependent on the weight of the load 8 so that the load is not moved downward by the weight thereof.

When the end of the control lever 7 is depressed downward for instance, the control lever 7 is turned around the axis of rotation of the potentiometer 20. As a result, the target speed signal $Vr$ is produced by the potentiometer 20 to drive the motor 13 provided in the driving section 2 (FIG. 1). The rotation of the motor thus driven is transmitted through the gear mechanism 15 to the output shaft 16, whereby the arms 3 and 4 are moved. In this operation, the target speed signal $Vr$ operates to drive the motor 13 so that the operating section 6 is moved downward, that is, the load 8 is moved downward.

The downward movement speed, in this case, is proportional to the rotational angle $\theta$ of the control lever 7. Accordingly, if the control lever is operated to decrease the rotational angle $\theta$ as the load 8 is moved downward, the downward movement speed of the load is decreased with a decrease of the angle $\theta$. Finally, when the angle $\theta$ becomes zero, that is, the control lever is at the neutral position $n$, the downward movement of the load is stopped, whereupon the load 8 is automatically balanced by the automatic balance signal generating device 17.

The automatic balance signal generating device 17 detects movement of the shaft 16 caused by the weight of the load, and converts the movement thus detected into, for instance, a voltage variation which is fed back, as the automatic balance signal S, to the amplifier 12 (adder 11). In this operation, since the device 17 is so designed that the automatic balance signal S is obtained in a known manner, e.g. from a potentiometer, which is provided in the device 17 and is frictionally connected to the output shaft 16, in such a manner that the balance signal S is increased and decreased by the relative weight of the load 8, a balance signal S corresponding to the variation of weight of the load is produced and the motor 13 is driven through the amplifier, thereby achieving the automatic balance operation.

In the case when the operator 10 moves the load upward or downward by operating the control lever 7, it is unnecessary to produce the automatic balance signal S, since movement is controlled substantially by target speed signal Vr. However, it is necessary that the automatic balance signals S be produced with respect to all of the at rest positions of the operating section 6 ranging from the uppermost position to the lowermost position.

On the other hand, when the control lever 7 is moved upward, a target speed signal $Vr$ corresponding to the angle $\theta$ is produced to move the load 8 upward. Similarly as in the case when the control lever 7 was moved downward, the upward movement of the load is stopped by operating the control lever in such a manner that the angle $\theta$ becomes zero, that is, the automatic balance of the load is obtained.

When the operator 10 removes his hand from the control lever 7, the control lever 7 is set at the neutral position $n$ by the mutual action of the springs 21 and 22 and the lifting apparatus is under the automatic balance condition.

As is clear from the description above, the conventional lifting apparatus forms a feedback control system, and the load is moved upward or downward in accordance with movement of the operator's hand holding the control lever.

Furthermore, in consideration of simplification in construction, convenience in installation and distance in load movement, the lifting apparatus is in the form of a crane having an arm. Therefore, the lifting arm is less mechanical rigid than machine tools. However, in general, the lifting apparatus has a mechanically determined upper limit position (hereinafter referred to as "mechanical upper limit position" when applicable) to which it can lift a load. Accordingly, if the load is lifted above the mechanical upper limit position, a relatively too great a mechanical stress is applied to the power transmission mechanism of the lifting apparatus. This is undesirable with respect to safety of operation. Furthermore, if the operator removes his hand from the control lever when the load has reached the mechanical upper limit position, the movement of the load is stopped with an excessively great stress being imparted to the power transmission mechanisms. This is dangerous.

In order to overcome these difficulties accompanying the conventional lifting apparatus, the following method has been employed. That is, the arrival of the load to the upper limit position is detected, for instance, by a limit switch thereby to stop the motor, and furthermore the load is moved downward by operating a push button switch, which produces a command signal for moving a load downward, instead of by operating the control lever. Thus, it is impossible to smoothly move a load upward or downward by the conventional lifting apparatus. Accordingly, it has been strongly demanded in the art to improve the above-described control system of the lifting apparatus.

SUMMARY OF THE INVENTION

Accordingly, it is an object of this invention to provide a lifting apparatus in which all of the above-described difficulties accompanying the conventional lifting apparatus have been overcome.

More specifically, an object of the invention is to provide a lifting apparatus in which when a load is lifted to a predetermined upper limit position, it is no longer moved upward even if a control lever is operated in a manner to normally move the load upward, and when an operator removes his hand from the control lever, the lifting apparatus is automatically balanced, and the load can be moved downward by moving the control lever downward.

Another object of the invention is to provide a lifting apparatus the operation of which is achieved safely by the employment of a simple electric circuit.

The nature, utility and principle of this invention will be more clearly understood from the following description and the appended claims when read with reference to the accompanying drawings, in which like parts are designated by like reference numerals or characters.

BRIEF DESCRIPTION OF THE DRAWINGS

In the accompanying drawings:

FIG. 1 is a schematic diagram illustrating a lifting apparatus to which this invention can be applied;

FIG. 2 is a block diagram illustrating the control system of the lifting apparatus shown in FIG. 1;

FIG. 3 is a perspective view of an operating section in the lifting apparatus shown in FIG. 1;

DETAILED DESCRIPTION OF THE INVENTION

Figure 4:
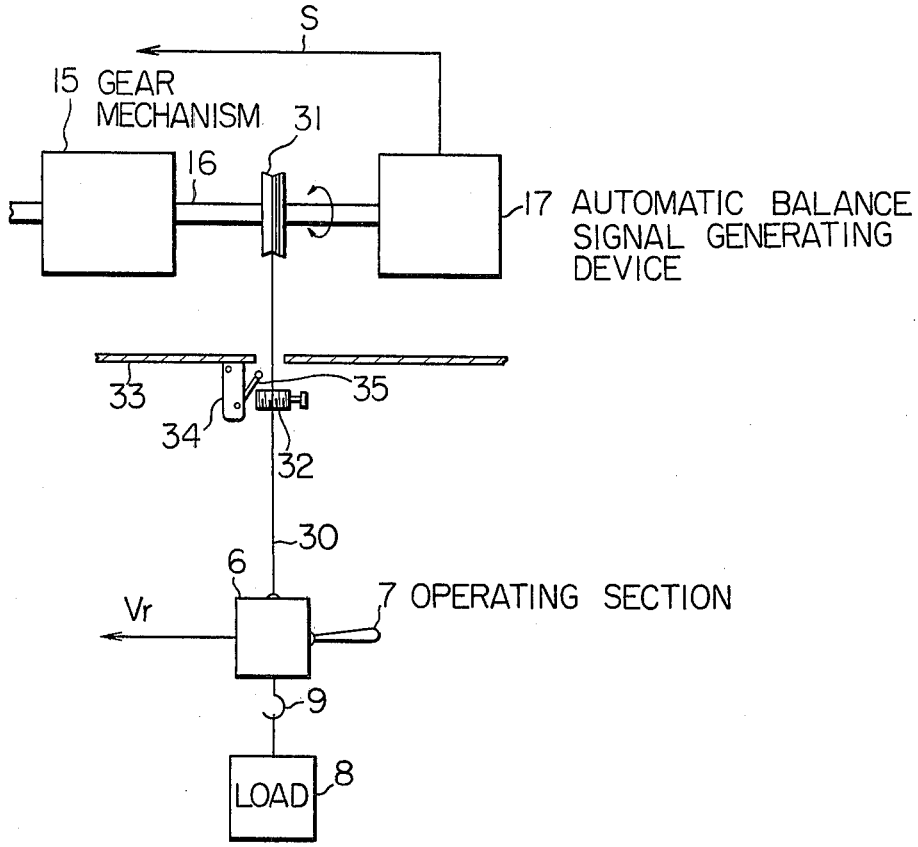
FIG. 4 is an explanatory diagram of an upper limit position setting device according to this invention.

This invention will be described with reference to FIG. 4 in which reference numeral 30 designates a rope which is wound on and unwound from a drum 31 provided on the output shaft 16 (FIG. 2). 32 designates a dog which is fixedly provided on the rope although the dog's position on the rope can be adjusted. 33 is a member fixed to the driving section 2 (FIG.2), and 34 is a limit switch provided on the member 33 so that its lever 35 is engaged with, or depressed by, the dog 32. The position of the dog on the rope is determined in such a manner that when the load 8 is lifted to the upper limit position, the dog comes into contact with the lever 35 of the limit switch 34. However, the dog is set to operate switch 34 slightly below the position thus determined, for safety of operation.

Figure 5:
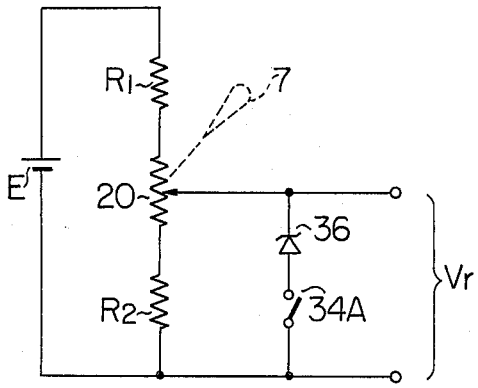
FIG. 5 is a control circuit diagram employed in this invention.
Figure 6:
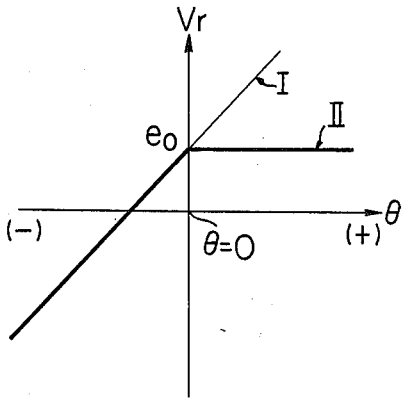
FIG. 6 is a graphical representation indicating characteristics of a target speed signal which controls the operation of the lifting apparatus shown in FIG. 1.

The limit switch 34 has contact means 34A which is included together with a Zener diode 36 in an electrical control circuit as is indicated in FIG. 5. This circuit produces a target speed signal $Vr$ as is indicated in FIG. 6. In the graphical representation of FIG. 6, $\theta > 0$, or a positive value of $\theta$, means that the control lever is operated to move the load upward; $\theta < 0$, or a negative value of $\theta$, means that the control lever is operated to move the load downward; and $\theta = 0$ means that the control lever is at the neutral position. Furthermore, a target speed signal Vr when $\theta = 0$, that is an output voltage $e_0$, corresponds to a bias voltage which is to produce a motor driving power necessary for balancing the load 8.

When the load 8 is below the upper limit position determined by the dog 32 and the limit switch 34, the contact means 34A is open. Therefore, in this case, the output of the potentiometer 20 connected through resistors $R_1$ and $R_2$ to a power source E is employed as a target speed signal $Vr$ (FIG.4). That is, the target speed signal $Vr$ has a characteristic I as indicated in FIG. 6, and serves to carry out the movement of the load as was described before.

Upon arrival of the load to the upper limit position, the dog 32 depresses the lever 35 of the limit switch 34 to close the switch 34. As a result, the output voltage of the potentiometer 20 becomes equal to the Zener voltage ($e_0$) of the Zener diode 36, and therefore the load is not moved upward even if the control lever 7 is moved further upward. In other words, when the load has reached the upper limit position, the target speed signal $Vr$ has a characteristic II as indicated in FIG. 6 further is, the target speed signal $Vr$ is maintained equal to the Zener voltage $e_0$ ($Vr = e_0$) even if the control lever is operated to move the load further upward ($\theta > 0$). Accordingly, the load 8 is maintained at a certain position. When the movement of the load 8 has been stopped as described above, the automatic balance signal generating device 17 is operated to carry out the automatic balance operation as described above.

Under this condition or upon the arrival of the load to the upper limit position, if the control lever is pushed downward such that $\theta < 0$, the output voltage of the potentiometer 20 is caused to be lower than the Zener voltage $e_0$. Therefore, the load is moved downward, and the contact means 34A of the limit switch 34 is opened and accordingly the target speed signal V*r* has the characteristic I again, that is, the movement of the load is controlled in accordance with the characteristic I.

The upper limit position determined by the dog 32 and the limit switch may be set at a desired position if it is below the mechanical upper limit position.

As is apparent from the above description, the upper limit position to which the load can be moved upward can be set, and the arrival of the load to the upper limit position can be positively and simply detected, according to this invention. Furthermore, since the load is never lifted higher than the mechanical upper limit position, this invention contributes to the safe operation of the lifting apparatus, and it should be highly appreciated that the very simple circuit device described above can achieve the various operations that the movement of the load is automatically stopped and balanced when the load has reached the upper limit position, and that the load is moved downward by pushing the control lever downward.

Although the combination of the dog and the limit switch is employed as the upper limit position setting device, this device may be constituted by a photosensitive element, a magnetic element, or a proximity switch.

What is claimed is:

1. In a lifting apparatus for moving a load vertically, said lifting apparatus being of the type including a driving section, a crane-type arm connected to and operable by said driving section, an operating section connected to said arm, a load carrying member attached to said operating section, said operating section including a manually movable control lever, and driving and control circuit means interconnecting said control lever and said driving section for transmitting a target speed signal proportional to movement of said control lever to said driving section to thereby move said arm and thus a load supported on said load carrying member in a direction and by an amount dependent upon corresponding said movement of said control lever; the improvement comprising:

upper limit position setting means operably connected to said lifiting apparatus for determining the upper limit position to which a load supported by said load carrying member is to be lifted;

normally open switch means positioned to be closed by said setting means when said upper limit position is reached;

a Zener diode electrically connected in series with said switch means; and the series circuit of said Zener diode and said switch means being connected in parallel with said driving and control circuit means, the resultant circuit formed when said switch means is closed comprising means for limiting the value of said target speed signal to a value to prevent further upward movement of said load, but for allowing downward movement of said load upon corresponding relative movement of said control lever.

2. The improvement claimed in claim 1, wherein said upper limit position setting means comprises a dog adjustably positioned on a rope connected to said operating section.

* * * * *